US007331293B2

(12) United States Patent
Saxby

(10) Patent No.: US 7,331,293 B2
(45) Date of Patent: Feb. 19, 2008

(54) MARKER PROJECTILE

(75) Inventor: Michael Ernest Saxby, Bexhill-on-Sea (GB)

(73) Assignee: UTM IP Limited, Mildenhall (GB)

( * ) Notice: Subject to any disclaimer, the term of this patent is extended or adjusted under 35 U.S.C. 154(b) by 175 days.

(21) Appl. No.: 10/516,556

(22) PCT Filed: May 30, 2003

(86) PCT No.: PCT/GB03/02344

§ 371 (c)(1),
(2), (4) Date: Jul. 27, 2005

(87) PCT Pub. No.: WO03/102492

PCT Pub. Date: Dec. 11, 2003

(65) Prior Publication Data

US 2005/0284325 A1 Dec. 29, 2005

(30) Foreign Application Priority Data

May 30, 2002 (GB) ..... 0212612.6

(51) Int. Cl.
*F42B 12/40* (2006.01)

(52) U.S. Cl. ..... 102/513; 102/502

(58) Field of Classification Search ..... 102/513, 102/501, 502, 512

See application file for complete search history.

(56) References Cited

U.S. PATENT DOCUMENTS 3,429,263 A * 2/1969 Lont et al. ..... 102/513
3,820,465 A * 6/1974 Delphia ..... 102/512
5,035,183 A * 7/1991 Luxton ..... 102/502
5,233,128 A * 8/1993 Lai ..... 102/511
5,654,524 A * 8/1997 Saxby ..... 102/513
6,378,439 B1 * 4/2002 Saxby ..... 102/513
7,143,699 B2 * 12/2006 Brock et al. ..... 102/502

FOREIGN PATENT DOCUMENTS

FR 2 762 385 A 10/1998
WO WO-95 14903 A 6/1995

* cited by examiner

*Primary Examiner*—James S. Bergin
(74) *Attorney, Agent, or Firm*—Lahive & Cockfield, LLP; Anthony A. Laurentano, Esq.

(57) ABSTRACT

The invention provides a marker projectile comprising a hollow body (1) having an opening (5) at the front; marker substance (8) disposed within the hollow body (1); and an expelling member (7) such as a metal ball within the hollow body (1), behind the marking substance (8). The hollow body (1) and expelling member (7) being configured such that upon impact of the projectile with a target, the momentum of the expelling member (7) relative to the hollow body (1) carries the expelling member (7) forwardly to expel the marking substance (8) through the opening (5), and characterised by a separator (4) extending at least partly over the front opening (5), the separator (4) defining two or more spaces (42*a*, 42*b*, 42*c*) through which the maker substance may pass when expelled through the opening (5).

17 Claims, 2 Drawing Sheets

MARKER PROJECTILE

RELATED APPLICATIONS

This application is a 35 U.S.C. 371 national stage filing of International Application No. PCT/GB03/02344, filed 30 May 2003, which claims priority to Great Britain Patent Application No. 0212612.6 filed on 30 May 2002 in Great Britain. The contents of the aforementioned applications are hereby incorporated by reference.

The present invention relates to a marker projectile and to the combination of a marker projectile and a cartridge.

BACKGROUND

Marker projectiles for use in training or war games are well known and examples of such projectiles are disclosed in U.S. Pat. No. 4,686,905, GB 2 284 252, GB 1 263 522, U.S. Pat. Nos. 3,528,662, 4,128,059 and 3,782,286.

Most of the aforementioned patents disclose projectiles in which a marker substance is held within a frangible casing or enclosure which ruptures upon impact with a target. A problem with projectiles such as bullets that are intended to break upon impact is that sometimes they fail to break. Moreover, because of the high impact required to break the frangible casing or enclosure, the projectiles can often cause injury upon impact with a person. A further problem is that the frangible casings or enclosures can sometimes break in a gun during the gun's reloading cycle.

Some of the aforementioned problems are addressed in GB 2 284 252 which discloses a projectile comprising a hollow casing having a perforated nose portion, a piston disposed within the casing, and a marking substance disposed forwardly of the piston. The piston is movable forwardly under force applied to it by gas used to discharge the projectile thereby compressing the marking substance and expelling it through the nose portion which thus becomes coated with the marking substance. Upon impact with a target, the marking substance is transferred to the target to mark the target.

However, a problem with projectiles, such as those disclosed in GB 2 284 252, in which the nose portion of the projectile is coated with a marking substance even before the projectile has left the gun barrel, is that the marking substance is dispersed by the rotation imparted to the projectile by the rifling in the gun barrel. Thus, the centrifugal force imparted by the spinning bullet causes the marking substance to move radially outwardly and consequently it can foul the barrel of the gun. A build up of marking substance, or its thermal decomposition products, in the gun barrel over time will inevitably have an adverse effect on the working of the gun. This problem is greatly exacerbated with bullets designed for use in high velocity rifles such as the NATO and US 5.56 mm calibre rifles where the rifling in the barrel must be such as to impart a very high spin rate to the bullet in order to ensure a stable trajectory. Even with relatively low velocity training ammunition, the high spin rates imparted by the rifling in high velocity rifles are still sufficient to cause the marking substance to disperse in the manner described above.

A still further problem with the marker projectile of GB 2 284 252 and other known marker projectiles is that they are unsuitable for small calibre barrels such as the current NATO and US 5.56 mm calibre self loading rifle barrels. This is not only because of the problem of radial dispersion of the marking substance referred to above, but also because the complexity of the bullet poses considerable manufacturing difficulties with smaller calibre bullets.

International Patent Application no. PCT/GB00/00241 discloses a marker projectile which goes some way to overcoming the aforementioned technical problems. The marker projectile in that patent specification is characterised by a marker substance being disposed in a hollow chamber with a front opening. An expelling member is positioned behind the marker substance with respect to the front opening. The configuration of the projectile is such that, on impact with a target, the momentum of the expelling member relative to the hollow body carries the expelling member forwardly towards the impacted target so as to expel the marking substance in a low impact manner. These marker projectiles are distinguished from known projectiles such as those disclosed in GB 2 284 252 where a piston within the projectile is driven forwardly by the propellant gases in the cartridge or gun to expel the marker substance. In the projectiles described in PCT/GB001/00241, the expelling member is insulated from the propellant gases; in other words, the propellant gases do not act on the expelling member to force it forwardly to cause expulsion of the marking substance.

The present invention aims to improve the spread of a marker substance expelled by a non-lethal low impact projectile of the type already described in PCT/GB00/00241.

SUMMARY OF THE INVENTION

In accordance with the present invention, there is provided a non-lethal marker projectile comprising a hollow body having an opening at the front; a marker substance disposed within the hollow body; and an expelling member within the hollow body behind the marking substance; the hollow body and expelling member being configured such that upon impact of the projectile with a target, the momentum of the expelling member relative to the hollow body carries the expelling member forwardly to expel the marking substance through the opening and characterised by a separator extending at least partly over the front opening, the separator defining two or more spaces through which the marker substance may pass when expelled through the opening.

The separator may conveniently be provided in the form of a cap which is secured to an outer wall or edge of the hollow body adjacent the front opening. Desirably, such a cap is secured in such a way that the aerodynamic properties of the projectile are not significantly compromised. The separator conveniently comprises one or more arms extending between the periphery of the front opening and the centre of the front opening. Optionally, the arms extend symmetrically from the centre to the periphery of the opening. Preferably, there are between two and four arms, desirably, there are three arms. Optionally, the separator has a domed configuration, the peak of the dome sitting in substantial alignment with the centre of the front opening.

Conveniently, a collar at the end of the hollow body adjacent the opening is provided with a peripheral protrusion, such as an angled flange, over which a complementary inner surface of the separator may be snap fit into position. Alternative means for securing the separator to the hollow body will not doubt occur to the skilled addressee and may, without limitation, include; providing complementary screw threads so that the separator can be screwed into position on the body, press fitting, spot welding, gluing or clipping.

The provision of the separator causes the marker substance, when propelled by the expelling member to be separated by a barrier (such as an arm) provided by the separator and to be expelled through the available spaces between elements of the barrier. This causes spreading of the marker substance over the target area, in a manner similar to water flowing through a sprinkler head. The mark on the target becoming more visible from a distance.

In one embodiment, the hollow body comprises a sleeve having a core body portion secured within a rear end thereof, the inner wall of the sleeve and a forwardly facing surface of the core body portion defining a chamber within which the marking substance and expelling member are disposed. The sleeve typically has a cylindrical form, a spigot portion of the core body member being received (preferably non-slidably) within the rear end of the sleeve. The sleeve is preferably formed from a material having a greater density than the material from which the core body portion is formed. Thus, for example, the sleeve can be formed from a metal material such as aluminium and the core body portion can be formed from a plastics material. The advantage of this feature is that (with the exception of the expelling member) the mass of the hollow body is concentrated towards its outer circumference which improves its ballistic properties.

It is most preferred that the hollow body is provided with means for centring the expelling member therein during flight of the projectile. By providing centring means, lateral movement of the expelling member during flight is prevented and the destabilising effect of such movement is therefore avoided. The centring means can be a recess in a forwardly facing surface within the interior of the hollow body. Where the hollow body comprises a core body portion and a sleeve, the centring means can comprise a recess in the forwardly facing surface of the core body portion. The recess constituting the centring means can be conical, frustoconical, hemispherical or part hemispherical, for example.

The expelling member can take a variety of shapes provided that it is rotationally symmetrical about its longitudinal axis. Preferably, it is of a spherical shape and more preferably it is a solid sphere.

The expelling member is typically formed from a material having a greater density than the material(s) from which the hollow body is formed. Thus, for example, the expelling member can be formed from steel. Where the projectile comprises a sleeve and core body portion, it is preferred that the expelling member has a greater density than the sleeve and the core body portion. It will appreciated also that, typically, the expelling member will have a density greater than the density of the marking substance.

In order to ensure that the expelling member can be carried forwardly by its own momentum within the hollow body upon impact with a target without its motion being retarded by frictional engagement with an inner surface of the hollow body, there is preferably a radial clearance between the centred expelling member and the inner wall of the hollow body (e.g. sleeve) sleeve.

In the projectiles of the invention, the motivating force urging the expelling member forwardly against the marking substance is the expelling member's own momentum. There is no need for a piston/cylinder arrangement driven by the expanding propellant gases within the gun barrel upon firing. On the contrary, where a core body portion/sleeve arrangement is used, means are typically provided for preventing forward movement of the core body portion in the manner of a piston relative to the sleeve. Such means can take the form of an abutment surface, for example an abutment flange, on the core body portion which rests against a rearwardly facing surface of the sleeve.

The present invention also contemplates the combination of a cartridge and a marker projectile as hereinbefore defined.

BRIEF DESCRIPTION OF THE DRAWINGS

For the purposes of exemplification, a preferred embodiment of the invention is now described with reference to the following Figures in which.

DESCRIPTION OF THE PREFERRED EMBODIMENT

Figure 1:
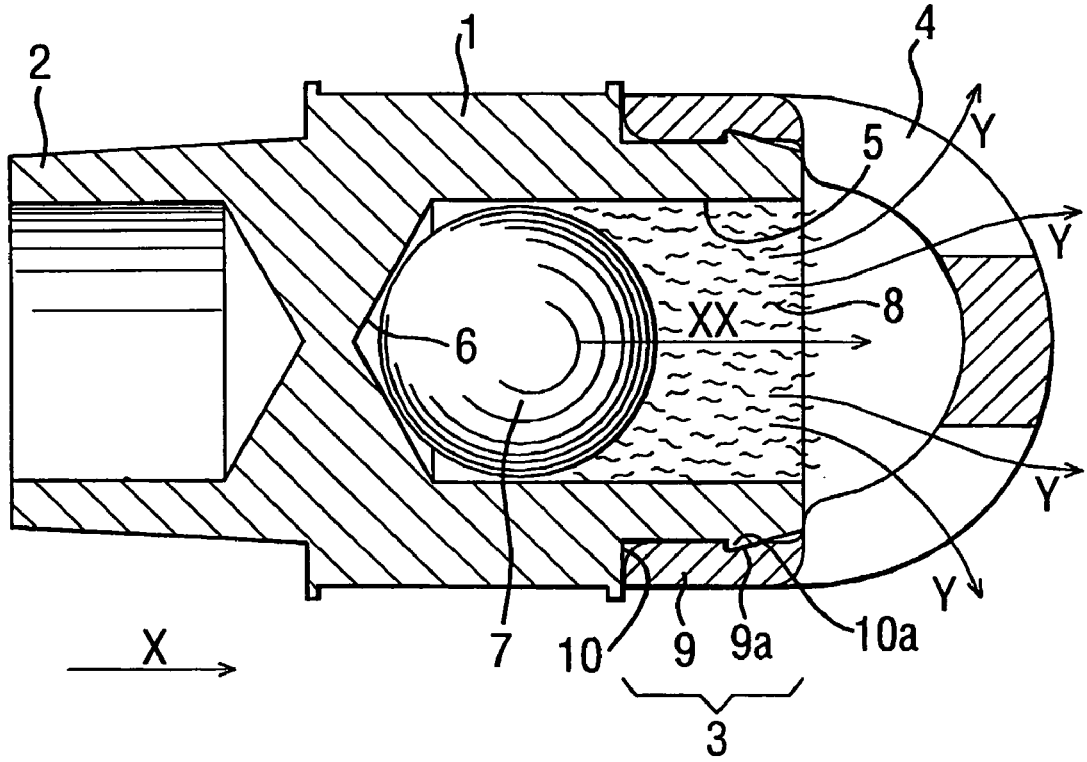
FIG. 1 shows a longitudinal section through one embodiment of a projectile of the invention.

As can be seen in FIG. 1, the projectile comprises a main body 1 having a tail portion 2 for seating in an appropriately configured cartridge (not shown), and a front portion 3 to which a separator 4 is secured. In the front portion 3 and behind the separator 4 is a hollow, generally cylindrical recess 5 having a tapered bottom 6. Seated within the recess 5, is an expelling member, represented as a ball bearing 7. Also within the recess but between the separator 4 and the ball bearing 7 is a quantity of marker substance 8.

The separator 4 is substantially dome shaped in profile and has a collar 9 configured to snap fit over a recessed portion 10 of an outer wall of the body 1 adjacent the front portion 3. The recessed portion 10 is provided with radially outwardly extending protrusions 10*a*, which are received in complementary indentations 9*a* positioned radially on an inner wall of the collar 9.

When the projectile of the embodiment of FIG. 1 is propelled from a gun (in a direction indicated by arrow X), the ball bearing 7 which is relatively heavy compared to the body of the projectile is slower to start moving and hence is carried with the projectile, retaining its position to the rear of the recess 5. When the projectile impacts a target or other object, the body 1 is stopped in its tracks, however, momentum built up by the ball bearing 7, causes it to continue its path (as indicated by arrow XX) and to move inside the body 1 towards the front portion 3, forcing the marker substance 8 to be expelled through the front portion 3. As the marker substance 8 passes through the front portion 3, it encounters the separator 4 and is thereby spread through spaces 4*a*, provided in the separator 4, as indicated by arrows Y.

Figure 2C:
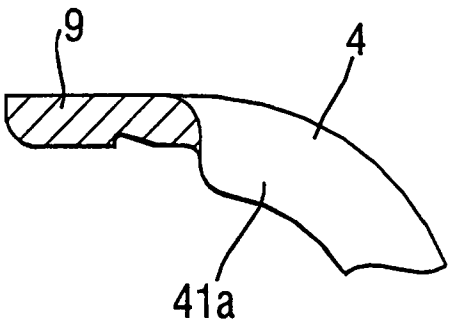
FIG. 2 shows in more detailed view, from three perspectives, the separator which distinguishes the projectile of the invention from the prior art.
Figure 2B:
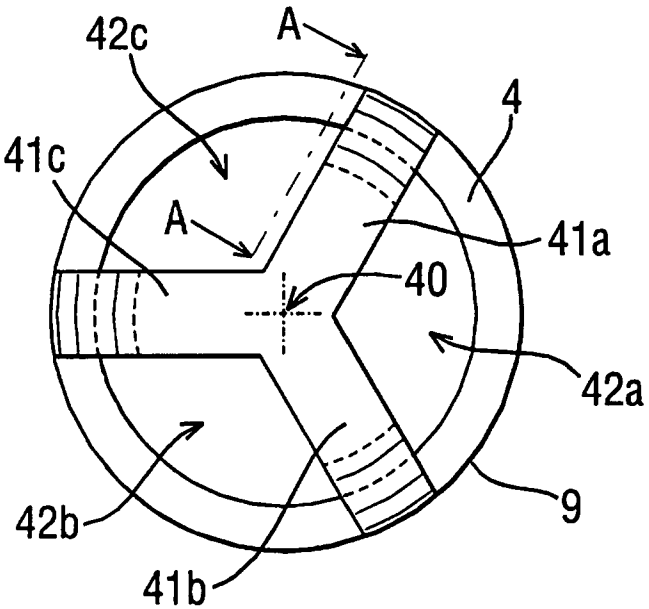
Figure 2A:
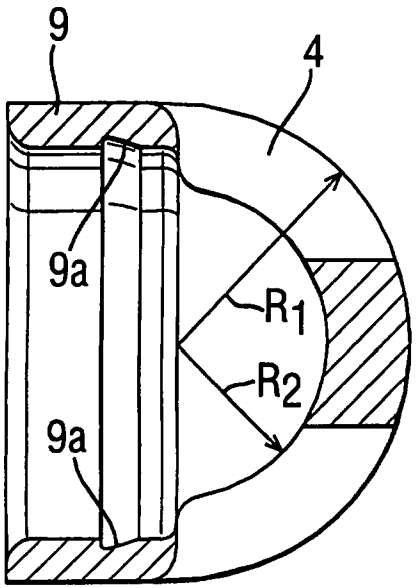

FIG. 2 shows three views, a longitudinal section (a) and an end view (b) of the separator 4 of FIG. 1, lastly, shown in (c), is a section through the plane A-A of view (b).

As can be seen from end view (b), the separator is made up of three arms 41*a*, 41*b*, and 41*c*, all extending from a common centre 40 of the separator 4, to the collar 9. The collar and arms define between them 3 spaces 42*a*, 42*b* and 42*c* through which the marker substance 8 is spread in use.

It is to be understood that the foregoing is purely exemplary of just one embodiment of the invention others of which will no doubt occur to the skilled addressee without departing from the true scope of the invention as defined by the appended claims.

The invention claimed is:

1. A non-lethal marker projectile, comprising a hollow body having an opening at the front; a marker substance disposed within the hollow body; an expelling member within the hollow body behind the marker substance; a portion of the hollow body separating the expelling member from an axial bore of the projectile; the hollow body and expelling member being configured such that upon impact of the projectile with a target, the momentum of the expelling member relative to the hollow body carries the expelling member forwardly to expel the marker substance through the opening, and a separator extending at least partly over the opening, the separator defining two or more spaces through which the marker substance may pass when expelled through the opening.

2. A non-lethal marker projectile as claimed in claim 1, wherein the separator comprises a cap which is secured to an outer wall or edge of the hollow body adjacent the opening.

3. A non-lethal marker projectile as claimed in claim 1, wherein the separator comprises one or more arms extending between a periphery of the opening and a center of the opening.

4. A non-lethal marker projectile as claimed in claim 3, wherein the arms extend symmetrically from the center to the periphery of the opening.

5. A non-lethal marker projectile as claimed in claim 3, wherein the separator comprises between two and four arms.

6. A non-lethal marker projectile as claimed in claim 5, wherein the separator comprises three arms.

7. A non-lethal marker projectile as claimed in claim 1, wherein the separator has a domed configuration, wherein a peak of the dome is in substantial alignment with a center of the opening.

8. A non-lethal marker projectile as claimed in claim 1, wherein the hollow body comprises centering means for centering the expelling member therein during flight of the projectile.

9. A non-lethal marker projectile as claimed in claim 8, wherein the centering means comprises a recess in a forwardly facing surface within an interior of the hollow body.

10. A non-lethal marker projectile as claimed in claim 9, wherein the recess is conical, frustoconical, hemispherical or part hemispherical.

11. A non-lethal marker projectile as claimed in claim 1, wherein the hollow body comprises a sleeve having a core body portion secured within a rear end thereof, an inner wall of the sleeve and a forwardly facing surface of the core body portion defining a chamber within which the marker substance and expelling member are disposed.

12. A non-lethal marker projectile as claimed in claim 11, wherein the sleeve has a cylindrical form, and a spigot portion of the core body member is received within a rear end of the sleeve.

13. A non-lethal marker projectile as claimed in claim 11, wherein a the sleeve is formed from a material having a greater density than the material from which the core body portion is formed.

14. A non-lethal marker projectile as claimed in 13, wherein the sleeve is formed from a metal material and the core body portion is formed from a plastics material.

15. A non-lethal marker projectile as claimed in 14, wherein the metal material is aluminium.

16. A non-lethal marker projectile as claimed in claim 1, wherein the expelling member is formed from a material having a greater density than the material from which the hollow body is formed.

17. A non-lethal marker projectile as claimed in claim 16, wherein the expelling member is formed from steel.

* * * * *